United States Patent [19]

Awano

[11] Patent Number: 4,708,416

[45] Date of Patent: Nov. 24, 1987

[54] ELECTRICAL CONNECTING TERMINAL FOR A CONNECTOR

[75] Inventor: Yoshiyuki Awano, Kawasaki, Japan

[73] Assignee: E. I. Du Pont de Nemours and Company, Wilmington, Del.

[21] Appl. No.: 37,131

[22] Filed: Apr. 10, 1987

Related U.S. Application Data

[63] Continuation of Ser. No. 816,845, Jan. 7, 1986, abandoned.

[30] Foreign Application Priority Data

Feb. 15, 1985 [JP] Japan ..... 60-19049[U]

[51] Int. Cl.[4] ..... H01R 13/11

[52] U.S. Cl. ..... 439/851

[58] Field of Search ..... 339/258 R, 258 P, 259 R

[56] References Cited

U.S. PATENT DOCUMENTS 3,363,224 1/1968 Glantz ..... 339/258 R

FOREIGN PATENT DOCUMENTS 2036990 2/1971 Fed. Rep. of Germany ... 339/258 R 2407063 9/1974 Fed. Rep. of Germany ... 339/258 R

*Primary Examiner*—Joseph H. McGlynn

[57] ABSTRACT

An electrical connecting terminal has an elongated flat base portion. A female contact portion is formed on one end portion in the longitudinal direction of the base portion. A terminal portion is formed on the other end portion of the base portion. The contact portion has a pair of opposing elastic contact segments and a pair of opposing support segments. The segments are supported by the segments and extend toward the terminal portion. A pair of engaging segments, which restrict outward deformation of the contact segments, are formed on an intermediate portion of the base portion. A wrinkle portion is formed on an arbitrary portion of the base portion corresponding to the contact segments, thereby contracting the base portion in its longitudinal direction. Consequently, the distal ends of the contact segments are positioned between the engaging segments. One surface of the wrinkle portion is projected, and the other surface thereof is recessed.

9 Claims, 3 Drawing Figures

ELECTRICAL CONNECTING TERMINAL FOR A CONNECTOR

This application is a continuation of application Ser. No. 816,845 filed Jan. 7, 1986, now abandoned.

BACKGROUND OF THE INVENTION

The present invention relates to an electrical connecting terminal with a female contact portion for a connector.

The female contact portion of an electrical connecting terminal for a connector has a pair of opposing elastic contact segments separated at a distance. When a male pin is inserted between the contact segments, an electric connection with the pin can be provided since the contact segments are electrically conductive.

In conventional electrical connecting terminals, however, contact segments can easily be deformed by "wiggle" movement of the male pin, which occurs when a connector is inserted or pulled out. The deformation is permanent, and results in poor contact with the male pin.

SUMMARY OF THE INVENTION

It is an object of the present invention to provide an electrical connecting terminal for a connector which can prevent excessive deformation of contact segments when they are inserted or pulled out.

According to the present invention, there is provided an electrical connecting terminal. The terminal has an elongated flat base portion. A contact portion is formed on one end of the base portion, and a terminal portion is formed on the other end thereof. The contact portion has a pair of opposing contact segments, and a pair of opposing support segments. The support segments extend from two side edges in the lateral direction of the base portion and are substantially perpendicular to the surface of the base portion. The contact segments extend from corresponding side edges of the support segments toward the terminal portion. A pair of engaging segments are formed on the center of the base portion to restrict outward deformation of the contact segments. The engaging segments extend from two side edges in the lateral direction of the base portion in substantially the same direction as the contact segments. At least one wrinkle portion is formed on the base portion corresponding to the contact segments by contracting the base portion in the longitudinal direction, so that the distal ends of the contact segments are located in the space between the engaging segments. One surface of the wrinkle portion projects outward, and the other surface thereof is recessed.

DESCRIPTION OF THE PREFERRED EMBODIMENTS

An embodiment of the present invention will be described with reference to FIGS. 1 to 3.

Figure 1:
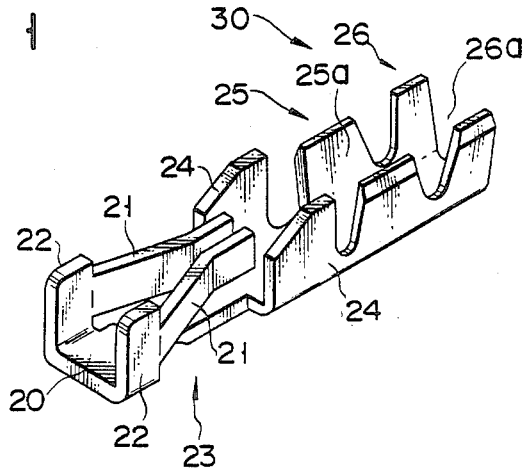
FIG. 1 is a perspective view of an electrical connecting terminal for a connector according to an embodiment of the present invention.

FIG. 1 shows an electrical connecting terminal for a connector. The terminal shown in FIG. 1 has elongated flat base portion 20. Contact portion 23 is formed on one end of portion 20 in the longitudinal direction, and terminal portion 30 is formed on the other end thereof. Portion 23 has a pair of opposing elastic contact segments 21, and a pair of opposing support segments 22. Segments 22 extend from two side edges in the lateral direction of portion 20 to be substantially perpendicular to the surface of portion 20. Segments 21 extend slightly inward from the corresponding side edges of segments 22 toward portion 30. Furthermore, segments 21 are bent slightly outward at their central portions so that their distal ends (free ends) are substantially parallel to each other.

A pair of engaging segments 24 are formed on the center of portion 20 to restrict outward deformation of segments 21. Segments 24 extend from two edges in the lateral direction of portion 20 in substantially the same direction as segments 21.

Portion 30 has two urging portions 25 and 26. Portions 25 and 26 have slots 25*a* and 26*a*, which have a substantially U-shaped cross-section and receive a single wire (not shown) from which a distal end coating is removed. Slot 25*a* is narrower than slot 26*a*. Portion 25 is located between portion 26 and segments 24, and the core wire of the wire is urged against portion 25 to electrically connect the core wire to the electrical connecting terminal. The wire is also urged on portion 26 to fix it on the terminal.

Wrinkle portion 27 is formed by pressing that part of portion 20 which corresponds to segments 21, so as to cross portion 20. The upper surface of portion 27 turns outward, and the lower surface thereof is recessed. Portion 27 is formed, contracting portion 20 in the longitudinal direction by a predetermined length, whereby the distal ends of segments 21 are located between segments 24. More specifically, portion 27 is formed, positioning segments 21 such that the distal ends of segments 21 can engage with segments 24 when they are excessively deformed outward.

Figure 2:
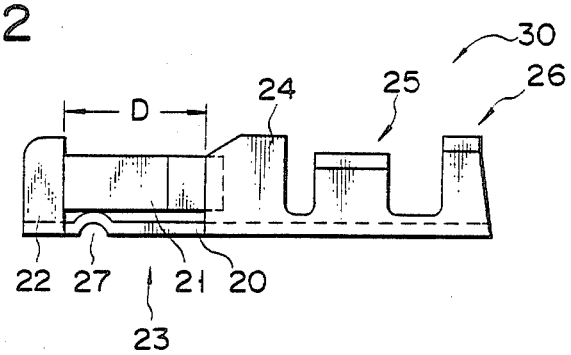
FIG. 2 is a front view of the terminal in FIG. 1.
Figure 3:
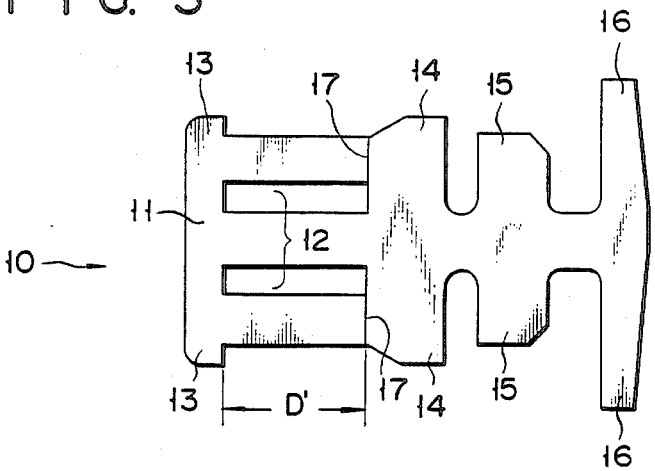
FIG. 3 is a plan view of plate 10 used for forming the terminal of FIG. 1.

FIG. 3 shows plate 10, which is used to form the electrical connecting terminal shown in FIGS. 1 and 2. Plate 10 can be obtained by punching a metal plate (e.g., phosphor bronze) with good conductivity and elasticity. Plate 10 has portion 11 extending in the longitudinal direction thereof. Portion 11 is used as base portion 20 of the electrical connecting terminal (FIGS. 1 and 2). A pair of rectangular elongated holes 12 are formed in one end portion of plate 10 and extend in the longitudinal direction of plate 10. Holes 12 are located on the sides of portion 11. Two side of plate 10 opposite to the long sides of holes 12 are notched. Portions 17 of plate 10 are sheared along lines extending outward from the short sides of holes 12 near the center of plate 10, thereby forming a pair of portions 13 adjacent to portion 11 at one end and used as contact segments 21 and support segments 22 (FIGS. 1 and 2). Two central side portions of plate 10 notches. These notches extend from the long sides of holes 12, forming a pair of portions 14 which are used as engaging segments 24. Two side portions in the lateral direction of plate 10 at the other end portion thereof also have notches extending from the long sides of holes 12 and thus forming a pair of portions 15 which are used as a part of urging portion 25 and a pair of portions 16 which are used as a part of urging portion 26.

A portion extending from one end portion to the central portion of plate 10 is bent substantially vertically along holes 12. As a result, contact segments 21 and support segments 22 shown in FIGS. 1 and 2 are formed from portions 13. Engaging segments 24 shown in FIGS. 1 and 2 are formed from portions 14. (Note that the bent shape of segments 21 has already been described).

The other end portion of plate 10 is bent into a U-shape, in the longitudinal direction. As a result, urging portion 25 is formed from portions 15 and the corresponding part of portion 11, and urging portion 26 is formed from portions 16 and the corresponding part of portion 11.

As described above, the electrical connecting terminal shown in FIGS. 1 and 2 can be formed by bending plate 10 of FIG. 3, which has been obtained by punching a metal plate.

It is difficult to locate the distal ends of segments 21 between segments 24 using only the above bending process. This is because portions 13 and 14 are positioned adjacent to each other and sandwich portions 17 therebetween. In this state, when segments 21 are greatly deformed outward, it is impossible to engage their distal ends with segments 24.

In this embodiment, wrinkle portion 27 (FIG. 2) is formed in that part of portion 20 which corresponds to segments 21. Due to this wrinkle portion 27, distance D between segments 22 and 24 (FIG. 2) is shorter by a predetermined value than distance D′ for which the those parts of portion 13 corresponding to segments 22 and 24 are separated before the bending process. (Distance D′ is equal to the length which hole 12 has before the bending process.) In this way, the distal ends of segments 21 can be located between segments 24 so that they are engaged with the latter when segments 21 greatly deformed outward.

A connector socket (not shown) is constituted by mounting a plurality of electrical connecting terminals (FIGS. 1 and 2) in a connector housing. When a plug (not shown) having a plurality of male pins is fitted in the socket, each pin is inserted in contact portion 23 of the corresponding terminal. Thus, the pin is brought into elastic contact with a pair of contact segments 21 of portion 23, thereby electrically connecting the pin and the terminal.

When the plug is inserted in or pulled out from the socket, "wiggle" occurs in the socket or plug. The distal ends of segments 21 are elastically deformed outward by "wiggle" movement of the pin. When wiggle is considerable, segments 21 are significantly deformed. In this case, the distal ends of segments 21 are engaged with segments 24, thereby restricting the further outward deformation of segments 21. Hence, permanent deformation of segments 21 can be prevented. With the terminal of the present invention, even when a wire with a large diameter is forcibly inserted between segments 21 and deforms them during a wire urging or harness operation, deformation is kept to a minimum.

The embodiment of the present invention has been described. However, the present invention is not limited to the particular embodiment, and various other changes and modifications may be made within the scope of the invention. For example, a plurality of wrinkle portions 27 can be formed, and can project upward or downward. Both upward and downward projections can be formed. Terminal portion 30 can comprise a male pin which is inserted in a through hole of a printed circuit board.

What is claimed is:

1. A terminal for an electrical connector comprising:

an elongated flat base having a female contact member at one end and a terminal portion at the other end;

a pair of opposing support sections extending upward from opposite lateral side edges at said one end of the flat base and defining an opening for insertion of a male pin into said female contact member;

a pair of opposing elastic contact sections extending from opposite corresponding side edges of said support sections, facing in a direction toward said other end of the flat base, said elastic contact sections extending rearward along said flat base and having distal ends pointing in a direction toward said other end of the flat base;

a pair of opposing engaging sections extending upward from said flat base and disposed at position intermediate the ends of said flat base, said distal ends of the rearward extending contact sections being adjacent to said engaging sections;

at least one wrinkle formed in a portion of said flat base between the support sections and the engaging sections, said base portion having a length prior to the formation of the wrinkle approximately equal to the length of the contact sections, said wrinkle having a projecting surface and a recessed surface and contracting the length of said flat base portion by a predetermined distance sufficient to move the distal ends of said elastic contact sections forward to a position between said pair of opposing engaging sections so that said engaging sections can restrict outward deformation of said elastic contact sections when a male pin is inserted therebetween.

2. A terminal according to claim 1, wherein said terminal portion comprises a first and second U-shaped member formed at the other end of said flat base; said first U-shaped member being closer to said other end than said second U-shaped member, said U-shaped members each defining a slot for receiving a wire, the slot of the second U-shaped member being narrower than the slot of said first U-shaped member.

3. A terminal according to claim 1 wherein the portion of said flat base extending between said support sections and engaging sections and each of the elastic contact section are formed from flat pieces of metal of approximately the same length, and the formation of said wrinkle causes the distal ends of the elastic contact sections to extend beyond said base portion into and between the space defined by said engaging sections.

4. A terminal for an electrical connector comprising:

an elongated flat base having a female contact member at one end and a terminal portion at the other end;

a pair of opposing support sections extending upward from opposite lateral side edges at said one end of the flat base and defining an opening for insertion of a male pin into said female contact member;

a pair of opposing elastic contact sections extending from opposite corresponding side edges of said support sections, facing in a direction toward said other end of the flat base, said elastic contact sections extending rearward along said flat base and having distal ends pointing in a direction toward said other end of the flat base;

a pair of opposing engaging sections extending upward from said flat base and disposed at position intermediate the ends of said flat base, said distal ends of the rearward extending contact sections initially not extending between said engaging sections; and at least one deformation formed in a portion of said flat base between the support sections and the engaging sections, said base portion having a length prior to the formation of the deformation approximately equal to the length of the contact sections, said deformation having a projecting surface and a recessed surface and extending completely across said base portion from one side thereof to the other, said deformation shortening the length of said flat base portion by a predetermined distance sufficient to move the distal ends of said elastic contact sections forward to a position between said pair of opposing engaging sections so that said engaging sections can restrict outward deformation of said elastic contact sections when a male pin is inserted therebetween.

5. A terminal according to claim 4, wherein said terminal portion comprises a first and second U-shaped member formed at the other end of said flat base; said first U-shaped member being closer to said other end than said second U-shaped member, said U-shaped members each defining a slot for receiving a wire, the slot of the second U-shaped member being narrower than the slot of said first U-shaped member.

6. A terminal according to claim 4 wherein the portion of said flat base extending between said supprot sections and engaging sections and each of the elastic contact section are formed from flat pieces of metal of approximately the same length, and the formation of said deformation causes the distal ends of the elastic contact sections to extend beyond said base portion into and between the space defined by said engaging sections.

7. A method for making the terminal of claim 4 comprising the steps of:

forming a substantially flat metal plate which contains in the plane thereof all the sections of said terminal, including said pairs of support sections, elastic contact sections and engaging sections, the distal end of each contact section being formed at this stage integral with its corresponding engaging section;

severing the distal end of each contact section from its corresponding engaging section;

bending said pairs of support sections and engaging sections upward until they extend substantially vertically from said flat base;

bending each contact section first inwardly and then outwardly so that the distal ends of said contact sections extend substantially parallel to one another and are separated by a distance which is less than the distance between the other ends of said contact sections joined to said support sections, said distal ends at this stage not extending between said engaging section; and forming said deformation across the flat base portion and thereby shortening the length of said flat base portion by a predetermined distance sufficient to move the distal ends of said elastic contact sections forward to a position between said pair of opposing engaging sections.

8. A terminal according to claim 4, wherein said elastic contact sections are positioned so that the distal ends thereof engage said engaging sections when said contact sections are excessively deformed outward by insertion of a male pin.

9. A terminal according to claim 8, wherein said contact sections extend slightly inward from the side edges of said support sections and are bent slightly outward at their intermediate portions.

* * * * *